US011614307B2

(12) United States Patent
Peterson et al.

(10) Patent No.: US 11,614,307 B2
(45) Date of Patent: Mar. 28, 2023

(54) SEAMLESS SMART MUNITIONS SYSTEM AND METHOD

(71) Applicant: Fenix Group, Inc., Chantilly, VA (US)

(72) Inventors: David Peterson, Haymarket, VA (US); Stefan Schaner, Ashburn, VA (US)

(73) Assignee: Fenix Group, Inc., Chantilly, VA (US)

( * ) Notice: Subject to any disclaimer, the term of this patent is extended or adjusted under 35 U.S.C. 154(b) by 188 days.

(21) Appl. No.: 17/338,557

(22) Filed: Jun. 3, 2021

(65) Prior Publication Data

US 2021/0293511 A1 Sep. 23, 2021

Related U.S. Application Data

(63) Continuation of application No. 16/863,236, filed on Apr. 30, 2020, now Pat. No. 11,035,649, which is a continuation of application No. 16/410,705, filed on May 13, 2019, now Pat. No. 10,641,582.

(60) Provisional application No. 62/670,415, filed on May 11, 2018.

(51) Int. Cl.

| | |
|---|---|
| ***F41G 7/30*** | (2006.01) |
| ***F41G 3/04*** | (2006.01) |
| ***F41G 7/22*** | (2006.01) |
| *F41G 7/00* | (2006.01) |

(52) U.S. Cl.

CPC ..... *F41G 7/301* (2013.01); *F41G 3/04* (2013.01); *F41G 7/2206* (2013.01); *F41G 7/2233* (2013.01); *F41G 7/2293* (2013.01); *F41G 7/30* (2013.01); *F41G 7/308* (2013.01)

(58) Field of Classification Search

None

See application file for complete search history.

(56) References Cited

U.S. PATENT DOCUMENTS

| | | | | |
|---|---|---|---|---|
| 3,778,007 | A * | 12/1973 | Kearney, II | F41G 7/30 244/3.14 |
| 5,855,339 | A * | 1/1999 | Mead | F41G 7/308 244/3.14 |
| 6,037,899 | A * | 3/2000 | Weber | F41G 3/142 701/469 |
| 7,338,009 | B1 * | 3/2008 | Bobinchak | F41G 3/04 244/3.1 |
| 7,494,089 | B2 * | 2/2009 | Williams | F41G 7/308 244/3.17 |
| 7,494,090 | B2 * | 2/2009 | Leal | F41G 7/308 244/3.17 |
| 7,947,936 | B1 * | 5/2011 | Bobinchak | F41G 3/04 701/1 |
| 8,084,724 | B1 * | 12/2011 | Brosch | F41G 7/308 244/3.17 |

(Continued)

OTHER PUBLICATIONS

M. Butler, "The Developer's Guide to Cursor on Target"; Mitre Center for Air Force Command & Control; Bedford, Massachusetts, USA; Aug. 2005. (Year: 2005).*

*Primary Examiner* — Bernarr E Gregory

(74) *Attorney, Agent, or Firm* — Polsinelli PC

(57) ABSTRACT

Systems and methods for deploying smart munitions may provide targeting metadata generated by surveillance networks to munitions deployment and guidance systems for smart munitions. Targeting metadata may be received by a conduit system and automatically processed to generate guidance and deployment data actionable by a munitions deployment platform.

20 Claims, 5 Drawing Sheets

(56) References Cited

U.S. PATENT DOCUMENTS

| | | | | |
|---|---|---|---|---|
| 8,748,787 | B2 * | 6/2014 | Weiss | F41G 3/04 244/3.13 |
| 9,541,350 | B1 * | 1/2017 | Sierchio | F41G 3/04 |
| 10,073,454 | B2 * | 9/2018 | Aboutalib | G05D 1/00 |
| 10,641,582 | B1 * | 5/2020 | Peterson | F41G 7/2206 |
| 11,035,649 | B2 * | 6/2021 | Peterson | F41G 7/34 |
| 2004/0068415 | A1 * | 4/2004 | Solomon | F41H 13/00 701/1 |
| 2004/0134336 | A1 * | 7/2004 | Solomon | F41H 13/00 89/1.11 |
| 2017/0254622 | A1 * | 9/2017 | Evans | F41G 7/2206 |
| 2017/0328679 | A1 * | 11/2017 | Smith | F41G 3/04 |
| 2017/0328680 | A1 * | 11/2017 | Smith | F41G 3/04 |
| 2017/0328681 | A1 * | 11/2017 | Smith | F41G 3/04 |
| 2017/0328682 | A1 * | 11/2017 | Smith | F41G 7/308 |
| 2017/0328683 | A1 * | 11/2017 | Smith | F41G 7/2206 |

* cited by examiner

SEAMLESS SMART MUNITIONS SYSTEM AND METHOD

CROSS-REFERENCE

This application is a Continuation of U.S. Non-Provisional application Ser. No. 16/863,236, filed Apr. 30, 2020, now. U.S. Pat. No. 11,035,649, which is a continuation of U.S. Non-Provisional application Ser. No. 16/410,705, filed May 13, 2019, now U.S. Pat. No. 10,641,582, which claims benefit to U.S. Provisional Application No. 62/670,415, filed May 11, 2018, the entire contents of which is incorporated herein by reference for all purposes.

TECHNICAL FIELD

Embodiments of the present invention generally relate to systems and methods for providing targeting support for munitions, and more specifically for providing a seamless logistics network supporting munitions deployment.

BACKGROUND

In battlefield situations, it is typically the case that surveillance networks, such as unmanned air vehicle ("UAV") fleets provide targeting information for guiding munitions to a target. It is often the case that targeting information is analyzed and relayed manually from the surveillance network to a munitions deployment team, which may guide deployed munitions through a munitions network, which is separate from the surveillance network.

SUMMARY

Embodiments of the present invention generally relate to systems and methods for providing targeting support for munitions, and more specifically for providing an automated logistics network supporting munitions deployment.

In one embodiment, a method includes establishing a link between one or more unmanned aerial vehicles and a smart munition, transmitting, over the link, coordinates to the smart munition, programming the smart munition with targeting information including at least in part the coordinates, and deploying the smart munition based on the programming.

In one embodiment, the link further includes a connection over a common wireless network and the smart munition comprising a munition with a radio receiver.

In one embodiment, the link is established through a control box including a radio, processor, and virtual core network.

In one embodiment, the grid coordinates are for a Military Grid Reference System (MGRS).

In one embodiment, the method further includes transmitting, from the one or more unmanned aerial vehicles to the smart munition and over the link, metadata.

In one embodiment, the coordinates are grid coordinates.

In one embodiment, the network is a combination of one or more dynamic mesh networks and one or more hub and spoke networks.

In one embodiment, the method further includes validating the smart munition by checking for a device entry in a database.

DETAILED DESCRIPTION

Figure 1A:
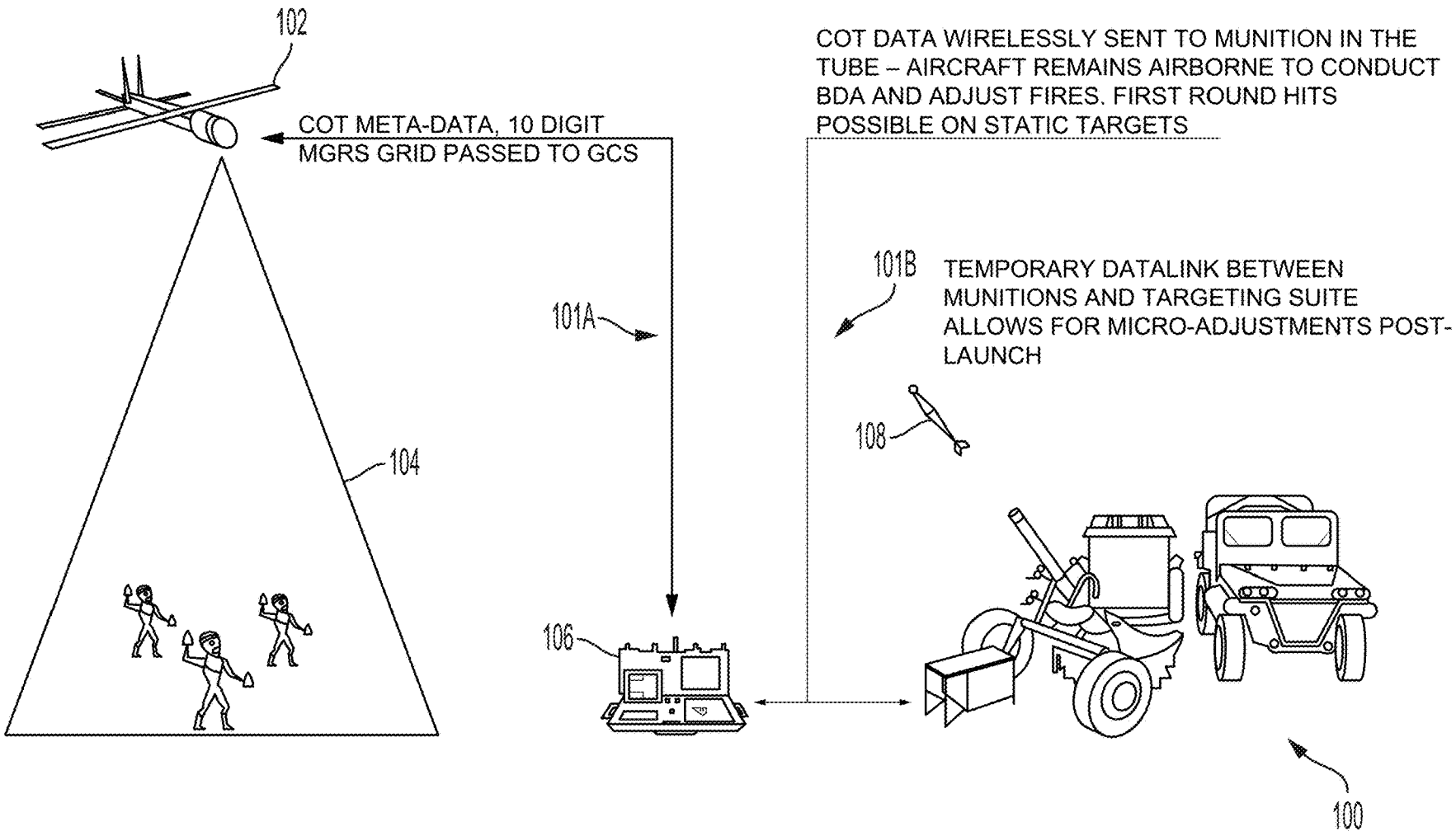
FIG. 1A is an illustration of an example operating environment for providing targeting support for munitions, in accordance with various embodiments of the subject technology.

Aspects of the present disclosure involve systems, methods, computer program products, and the like, for linking organic munitions to aerial and ground-based sensor Cursor-on-Target ("COT") data providers. COT data may be provided to the munitions over a wireless network and, in some examples, may provide continuous updates to munitions prior to and during deployment (e.g., on route to a target, etc.). In some examples, munitions may be "smart" and include onboard processing and/or a sustained and responsive linkage over the wireless network to COT providers and/or controllers. Furthermore, smart munitions may adjust their flight paths based on the sustained linkage.

Typically, munitions receive preprogrammed instructions, such as targeting directives, prior to deployment. Furthermore, preprogrammed targeting directives may be manually entered and are susceptible to human error. Manual entry also takes substantial time during which an intended target may move or respond and/or preemptively attack the munitions launch point, thus causing an increased likelihood of friendly casualties and/or increasing collateral damage or miss rates by the deployed munitions. Systems and methods disclosed herein can shorten a "kill chain," or time between acquiring telemetry on a target and impacting a munition on the target, and thus increase the likelihood of first round hits, increase the lethality of munitions hits, and reduce a target's freedom of movement and/or ability to exit a "kill zone," or an area to which the munitions are deployed.

For example, a typical targeting solution for mortar rounds can take approximately four minutes to deploy effectively to a target (e.g., a four-minute kill chain). In some examples, the systems and methods disclosed herein can provide an approximately 15-second kill chain for deploying effective mortar rounds to a target. Further, the amount of time necessary for training indirect fires (e.g., mortar, artillery, and the like) personnel may be reduced due to the system offloading logistics processing from human personnel to the systems and methods disclosed herein and so provide efficiency advantages over, for example, near-peer adversaries.

Delivery of data from COT capable UAV to munitions can increase accuracy and speed at which munitions can be deployed to targets. While UAV are referred to in examples provided herein, it is understood that other COT capable sensor systems, such as land based radar systems and the like, may provide data to munitions as discussed below. UAV are used for explanatory purposes and are understood to be but one of many examples of COT capable sensor systems which can be used as disclosed herein. The UAV can communicate with each other and with the munitions via a common network architecture. In some examples, multiple and/or various frequency bands can be used for the common network architecture. The common network architecture may include one or more secured channels, VPNs, encryption layers, and the like.

Software defined radios may provide for any band to be used for the common network architecture. Bands can be selected based on operation parameters, such as, without imputing limitation, target distance, terrain, complexity of resolving a targeting solution, and the like. For example, and without imputing limitation, bands may include 4G, LTE, 5G, Mobile Ad-Hoc Network ("MANET") L, S, and/or C bands, and/or any other radio waveform applied to military requirements. While particular bands and waveforms are enumerated herein, it will be understood by a person having ordinary skill in the art with the benefit of this disclosure that the systems and methods disclosed herein are not limited to any particular band or waveform, but can include various bands or waveforms as well as legacy Radio over IP ("RoIP") networks and the like. In some examples, multiple bands and/or switching bands may be employed for increased security and/or network stability.

Metadata may be delivered over the common network architecture to the munitions. In one example, a group communication system ("GCS") may receive metadata from UAV and other targeting sensors over the common network architecture and transmit the metadata and/or derived information based on the metadata to a smart munition. Metadata can include, for example and without imputing limitation, 8-10 digit grid coordinate values for each of target position, UAV airspeed, altitude, position, flight pattern, and/or other flight characteristic information that may have bearing on indirect fires (e.g., munitions deployment), digital terrain information such as terrain elevation, geography, and/or other terrain information that may have bearing on direct or indirect fires, time of day, temperature, and/or other weather information. The smart munitions and/or the GCS cause the metadata to resolve targets at the point of munition launch and thus widen a span of usability of a window of opportunity to strike.

In some examples, the GCS can aggregate data from multiple sources and formats to provide up-to-date targeting information and/or resolution to a linked smart munition. Metadata from UAV and other sources can be broadcast to the entire network in a continuous update stream and processed by the GCS and/or munition control interfaces. For example, a UAV can track a moving vehicle, providing to the network a continuously updating stream of 10-digit Military Grid Reference System ("MGRS") coordinates related to the vehicle position. The GCS may use the continuously updating stream to resolve a target for a munition pre-deployment and/or link the munitions to the updating stream. Further, the munition may make flight adjustments post-deployment (e.g., in-flight) in response to the linked continuously updating stream from the UAV in order to successfully deploy to the tracked moving vehicle.

Figure 2A:
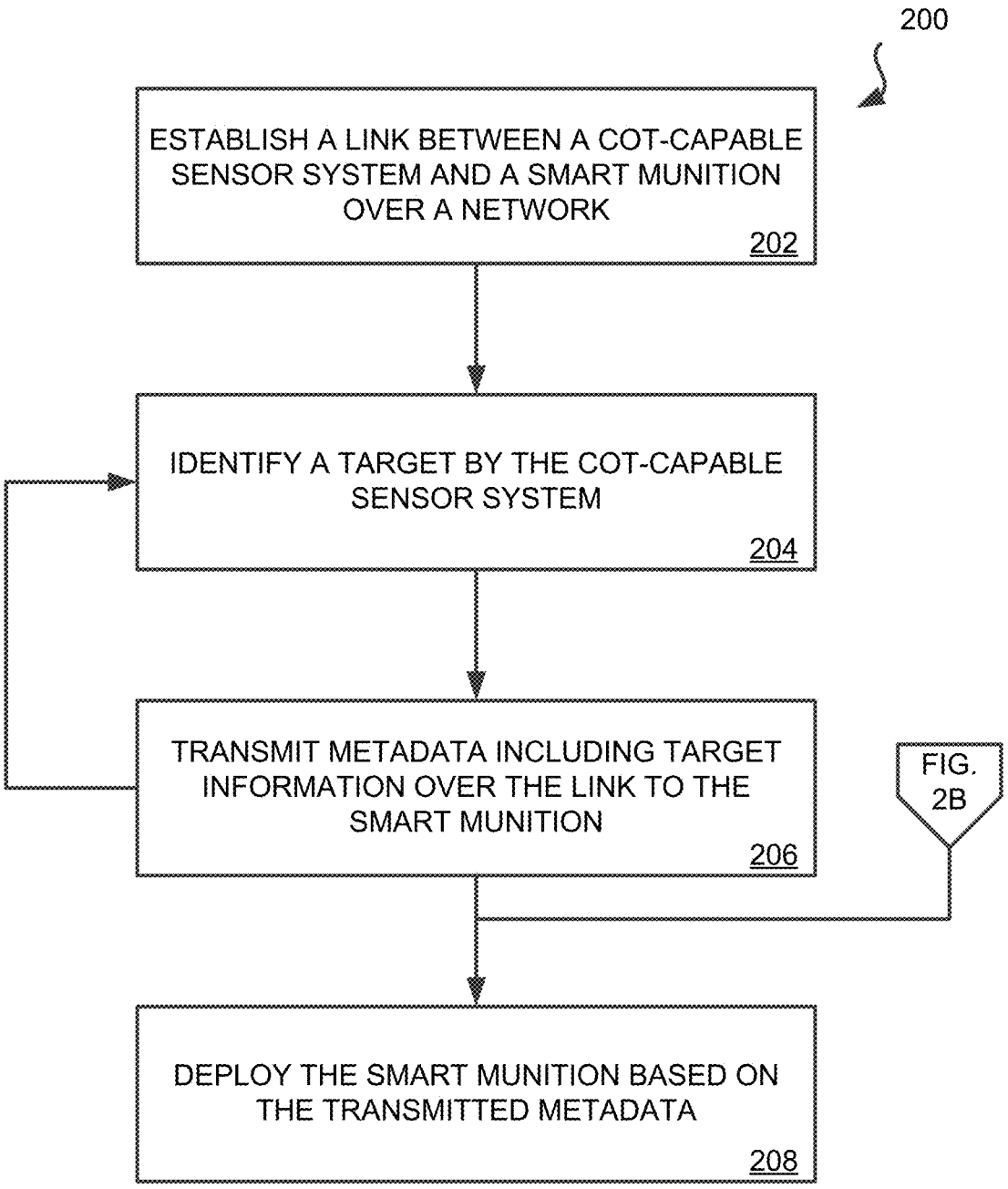
FIG. 2A is flowchart for an example method of providing targeting support for munitions, in accordance with various embodiments of the subject technology.

FIG. 1A and FIG. 2A depict smart munitions operating environment 100 and munitions targeting method 200, respectively. Smart munitions operating environment 100 can include a network across which sensor systems and munitions may communicate, demarcated here as a sensors side network portion 101A and a munitions side network portion 101B. A link between a UAV 102, or other COT capable sensor system, and a munition 108 can be established across the network (operation 202). In some examples, a validation and/or authentication process may occur to ensure that only authorized munitions and COT capable sensor systems interact. The validation may include checking a database or other data storage for credential information (e.g., device identification and the like).

While the network is depicted here as demarcated into two sides, it will be understood by a person having ordinary skill in the art that various network architectures may provide a communications plane within smart munitions operating environment 100. For example, and without imputing limitation, UAV may communicate directly with munitions, multiple subnetworks may be included along with aggregating receivers, and other configurations as will be apparent to a person having ordinary skill in the art may be utilized over smart munitions operating environment 100 as a communications plane.

UAV 102 acquires COT metadata for a target, such as 10-digit MGRS information, through sensors onboard UAV 102 (operation 204). The COT metadata may be associated with particular targets 104 which may, in some examples, be identified by onboard UAV 102 systems such as computer vision, targeting systems, and the like. In some examples, a remote processor or service may provide target identification and tracking for UAV 102.

Nevertheless, UAV 102 transmits COT metadata referencing targets 104 to a GCS 106 via network portion 101A for downstream provision of the COT metadata to munition 108 (operation 206). GCS 106 may further process the received COT metadata. In some examples, multiple UAVs may transmit COT metadata which can be aggregated into a higher resolution target. In some examples, other sensors, including, without imputing limitation, ground-based sensors can transmit COT metadata to GCS 106. The transmission may be a network-wide transmission or may be a direct transmission. In both cases, the transmission can be encrypted and include other credentialing data (e.g., such as a transmitter identifier and the like).

GCS 106, having received COT metadata from UAV 102, may transmit all or a portion of the received COT metadata to munition 108 (linked to UAV 102) via network portion 101B. In some examples, multiple munitions may be linked to UAV 102 through either a direct peer-to-peer linkage or via GCS 106. In some examples, GCS 106 can initially link UAV 102 and munition 108, which may thereafter communicate directly with each other over a shared network.

Munition 108 can then be deployed to targets 104 using the received COT metadata (operation 208). Munition 108 can further include an onboard computer and/or radio receiver (not depicted). The radio receiver may be a programmable software radio included as part of, or in addition to, the onboard computer. Munition 108 may receive additional updates from UAV 102 or GCS 106 while in-flight to targets 104. Munition 108 can then use the additional updates to adjust a flight trajectory and the like in order to increase the chance of successfully striking targets 104.

The in-flight updates may comprise COT metadata similarly to above. In some examples, GCS 106 may preprocess the COT metadata in order to provide streamlined data to munition 108 so as to hasten in-flight computing. In other examples, UAV 102 may provide COT metadata directly to munition 108 over a shared network so as to reduce latency and increase accuracy of the provided COT metadata as the munition travels to targets 104.

Figure 1B:
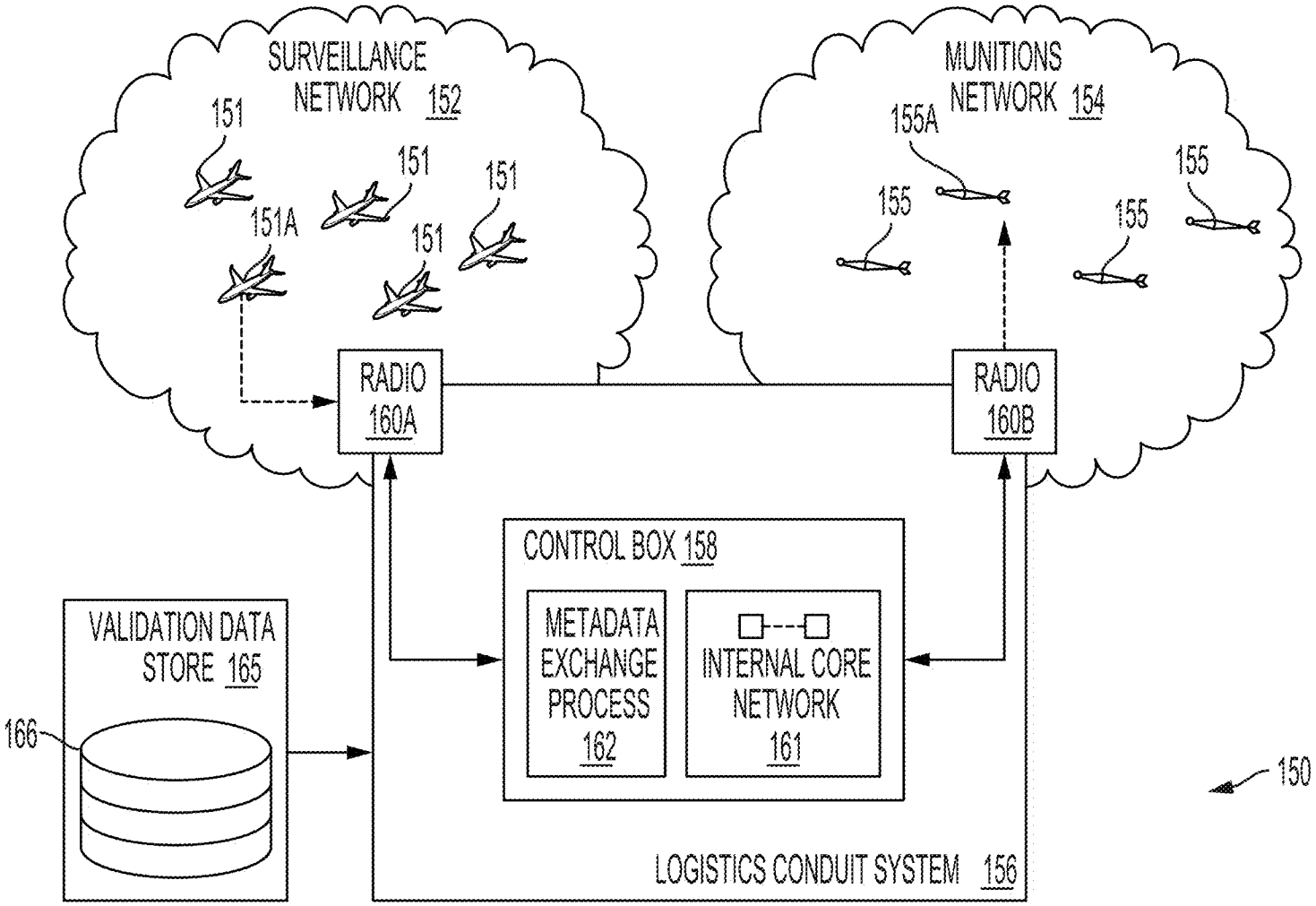
FIG. 1B is an illustration of an example system for providing targeting support for munitions, in accordance with various embodiments of the subject technology.

FIG. 1B is a block diagram depicting a smart munitions targeting system 150 which seamless connects a surveillance network 152 and a munitions network 154 to provide rapid target resolution and support. In some examples, smart munitions targeting system 150 may be deployed in smart munitions operating environment 100 discussed above in reference to FIG. 1A. While surveillance network 152 and munitions network 154 are depicted here as distinct networks, it is understood that this is for explanatory purposes only and, in some examples, surveillance network 152 and munitions network 154 may be sub-networks or abstracted segregated network traffic flows of a larger shared network or the like. Either or both surveillance network 152 and munitions network 154 may operate over any medium as will be understood by a person having ordinary skill in the art. For example, networking may be performed over LTE mobile network protocols and bands, radio frequency, cellular, 4G, 5G, WiFi, sonic, optical, etc. and can transmit logistics and other data between network endpoints.

In particular, surveillance network 152 includes a fleet of one or more UAVs 151 in communication with a UAV ground controller and/or each other. In some examples, UAVs 151 may all be the same type UAV (e.g., predator drone, etc.) communicating over a dedicated network. In some examples, the fleet of UAVs 151 may include multiple types of drones within a shared control group and may communicate with each other via the ground controller or the like. UAV 151A may generate targeting (e.g., COT, etc.) metadata by identifying and/or tracking a munitions target based on onboard (e.g., autopilot, vision and tracking modules, etc.) processes and/or ground-based (e.g., remote pilot, etc.) processes. Nevertheless, UAV 151A transmits targeting metadata to a logistics conduit system 156 for deploying munitions to the munitions target.

Logistics conduit system 156 includes a radio 160A for interfacing with surveillance network 152 and a radio 160B for interfacing with munitions network 154. In some examples, radios 160A-B can be software radios or may include one or more additional radios.

Munitions networks 154 includes a communications network or mesh between one or more munitions 155 and a ground munitions controller. In some examples, each munition 155 communicates with logistics conduit system 156 for deploying and guiding respective munitions 155. Here, a munition 155A has established a link with logistics conduit system 156 via radio 160B to receive appropriate targeting metadata for deploying munition 155A to a tracked target, etc.

Logistics conduit system 156 receives targeting metadata from surveillance network 152 and provides appropriate targeting and guidance data to munition 155A based on the received target metadata. Received metadata is provided to a control box 158 for further processing. In some examples, logistics conduit system 156 may include preprocessing and or analytic processes (not depicted) for processing the received metadata prior to being provided to control box 158.

Control box 158 includes a metadata exchange process 162 for converting metadata received from surveillance network 152 to a format actionable by one or more munitions 155 (e.g., munition 155A). In some examples, conversion processes and/or functions may be retrieved from an external data store (not depicted) or from a dedicated store within logistics conduit system 156.

Control box 158 further includes an internal core network 161 which may include, for example and without imputing limitation, one or more virtual networks and/or virtual network endpoints. In some examples, internal core network 161 may bind together surveillance network 152 and munitions network 154. Internal core network 161 may include endpoint bindings, via radios 160A-B, to surveillance network 152 and/or munitions network 154.

In some examples, logistics conduit system 156 may communicate with a validation data store 165 to validate an identity of munition 155A and/or UAV 151A. In some examples, validation data store 165 may further store conversion schema or the like for metadata exchange process 162. For example, metadata exchange process 162 may retrieve the conversion schema based on a retrieved identity of UAV 151A and munitions 155A. Validation data store 165 may include one or more databases 166 for storing, managing, and retrieving data.

Figure 2B:
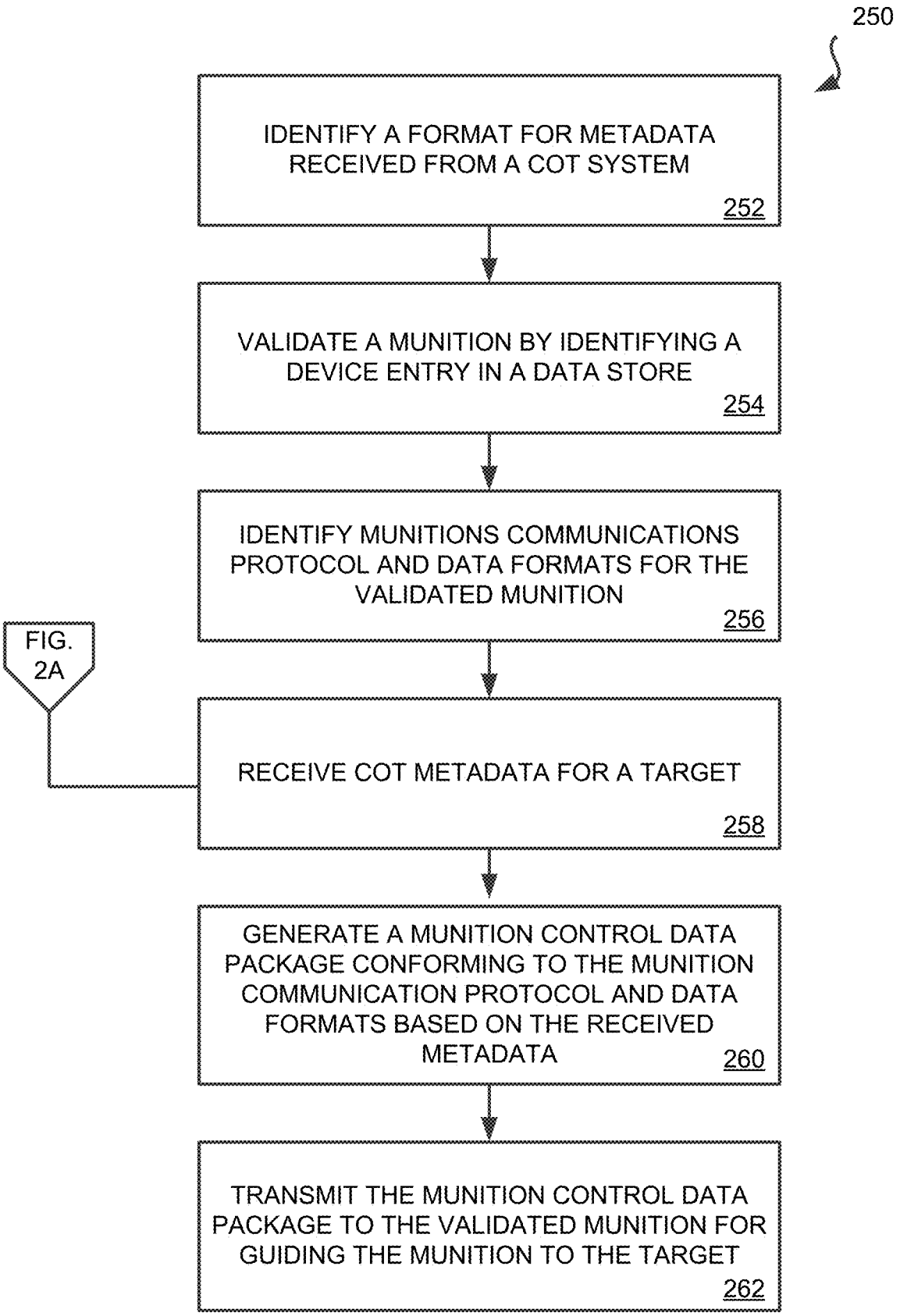
FIG. 2B is a method flowchart for generating targeting information for a munitions guidance system, in accordance with various embodiments of the subject technology.

FIG. 2B is a method 250 for guiding a munition based on targeting data provided by a targeting (e.g., COT) system. While method 250 is depicted as initiating from step 252, in some examples method 250 may initiate from step 256 following step 206 of method 200 discussed above in reference to FIG. 2A.

At step 252, a format is identified for metadata received from a COT system. The format may be identified implicitly (e.g., based on a parsing of its structure) or may be identified via an identifier or the like retrieved from a providing UAV or associated with the metadata in a data store.

At step 254, a munition is validated by identifying a device entry in a data store. The munition may be identified by the metadata, such as by a destination field or the like. In some examples, the munition may be identified and validated prior to UAV or COT system deployment. In some examples, the munition may be required to be validated before respectively provided metadata is used for deploying and/or guiding a munition.

At step 256, a munitions communication protocol and data formats for the validated munition are identified. In some examples, munitions communication protocol may be preselected from a selection prior to UAV and/or COT system deployment. In some examples, munitions communication may be select dynamically or quasi-dynamically based on munitions identification information.

At step 258, COT metadata is received for a target. For example, the COT metadata may be received directly from a UAV, such as UAV 151 discussed above in reference to FIG. 1B. In some examples, the COT metadata may be preprocessed to identify appropriate formats and/or perform validation procedures.

At step 260, a munition control data package conforming to the munition communication protocol and data formats based on the received metadata is generated. The munition communication protocol may be identified based on a munition identifier such as that used to validate the munition at step 254.

At step 262, the munition control data package is transmitted to the validated munition for guiding the munition to the target. In some examples, the munition control data package may be transmitted directly the validated munition for receipt by onboard controllers. In some examples, the munition control data package can be transmitted to an interim deployment control terminal for automatically providing downstream to the validated munitions.

Figure 3:
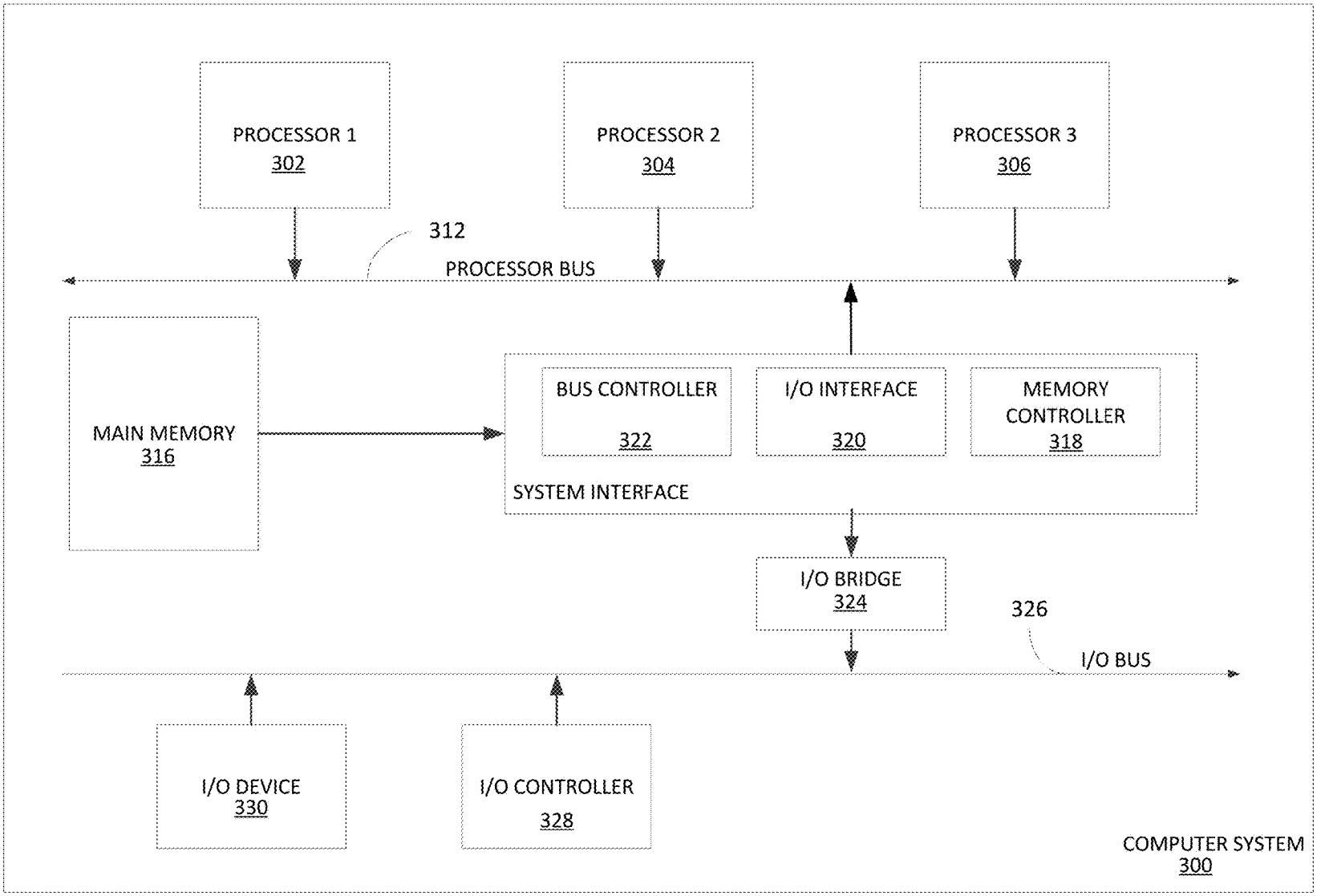
FIG. 3 is an example system which may implement the systems and methods discussed herein, in accordance with various embodiments of the subject technology.

FIG. 3 is a block diagram illustrating an example of a computing device or computer system 300 which may be used in implementing the embodiments of the components of the systems and methods disclosed above. For example, the computing system 300 of FIG. 3 may be logistics conduit system 156 discussed above. The computer system (system) includes one or more processors 302-306. Processors 302-306 may include one or more internal levels of cache (not shown) and a bus controller or bus interface unit to direct interaction with the processor bus 312. Processor bus 312, also known as the host bus or the front side bus, may be used to couple the processors 302-306 with the system interface 314. System interface 314 may be connected to the processor bus 312 to interface other components of the system 300 with the processor bus 312. For example, system interface 314 may include a memory controller 314 for interfacing a main memory 316 with the processor bus 312. The main memory 316 typically includes one or more memory cards and a control circuit (not shown). System interface 314 may also include an input/output (I/O) interface 320 to interface one or more I/O bridges or I/O devices with the processor bus 312. One or more I/O controllers and/or I/O devices may be connected with the I/O bus 326, such as I/O controller 328 and I/O device 340, as illustrated.

I/O device 340 may also include an input device (not shown), such as an alphanumeric input device, including alphanumeric and other keys for communicating information and/or command selections to the processors 302-306. Another type of user input device includes cursor control, such as a mouse, a trackball, or cursor direction keys for communicating direction information and command selections to the processors 302-306 and for controlling cursor movement on the display device.

System 300 may include a dynamic storage device, referred to as main memory 316, or a random access memory (RAM) or other computer-readable devices coupled to the processor bus 312 for storing information and instructions to be executed by the processors 302-306. Main memory 316 also may be used for storing temporary variables or other intermediate information during execution of instructions by the processors 302-306. System 300 may include a read only memory (ROM) and/or other static storage device coupled to the processor bus 312 for storing static information and instructions for the processors 302-306. The system set forth in FIG. 3 is but one possible example of a computer system that may employ or be configured in accordance with aspects of the present disclosure.

According to one embodiment, the above techniques may be performed by computer system 300 in response to processor 304 executing one or more sequences of one or more instructions contained in main memory 316. These instructions may be read into main memory 316 from another machine-readable medium, such as a storage device. Execution of the sequences of instructions contained in main memory 316 may cause processors 302-306 to perform the process steps described herein. In alternative embodiments, circuitry may be used in place of or in combination with the software instructions. Thus, embodiments of the present disclosure may include both hardware and software components.

A machine readable medium includes any mechanism for storing or transmitting information in a form (e.g., software, processing application) readable by a machine (e.g., a computer). Such media may take the form of, but is not limited to, non-volatile media and volatile media. Non-volatile media includes optical or magnetic disks. Volatile media includes dynamic memory, such as main memory 316. Common forms of machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions.

Embodiments of the present disclosure include various steps, which are described in this specification. The steps may be performed by hardware components or may be embodied in machine-executable instructions, which may be used to cause a general-purpose or special-purpose processor programmed with the instructions to perform the steps. Alternatively, the steps may be performed by a combination of hardware, software and/or firmware.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations together with all equivalents thereof.

We claim:

1. A method comprising:

establishing, over a munitions network, a munitions network link between a smart munition and a group communication system (GCS);

generating target coordinates for the smart munition, the target coordinates generated based at least in part on one or more data transmissions received by the GCS over a surveillance network communicatively coupling the GCS to a plurality of Cursor-on-Target (COT)-capable sensors;

transmitting the target coordinates to the smart munition via the munitions network link;

programming the smart munition with targeting information based at least in part on the target coordinates; and deploying the smart munition based on the programming.

2. The method of claim 1, wherein the one or more data transmissions received by the GCS over the surveillance network comprise COT metadata obtained by the plurality of COT-capable sensors.

3. The method of claim 2, further comprising associating the COT metadata obtained by the plurality of COT-capable sensors with one or more identified targets.

4. The method of claim 2, wherein at least a first portion of the plurality of COT-capable sensors are provided on one or more of a plurality of unmanned aerial vehicles.

5. The method of claim 4, wherein a second portion of the plurality of COT-capable sensors are provided as ground-based sensors, the second portion different than the first portion of the plurality of COT-capable sensors.

6. The method of claim 1, wherein the munitions network and the surveillance network are provided as separate networks.

7. The method of claim 6, wherein the munitions network comprises a mesh network between one or more smart munitions and the GCS.

8. The method of claim 1, wherein generating target coordinates for the smart munition comprises:

generating, using the GCS, a munition control data package, the munition control data package including at least the target coordinates.

9. The method of claim 8, wherein the munition control data package is generated based on at least:

a munition communication protocol determined for the smart munition; and one or more data formats of COT metadata transmissions received from the plurality of COT-capable sensors.

10. A system comprising:

a processor; and a non-transitory computer readable medium storing instructions, which when executed by the processor causes the processor to transmit instructions causing the system to:

establish, over a munitions network, a munitions network link between a smart munition and a group communication system (GCS);

generate target coordinates for the smart munition, the target coordinates generated based at least in part on one or more data transmissions received by the GCS over a surveillance network communicatively coupling the GCS to a plurality of Cursor-on-Target (COT)-capable sensors;

transmit the target coordinates to the smart munition via the munitions network link;

program the smart munition with targeting information based at least in part on the target coordinates; and deploy the smart munition based on the programming.

11. The system of claim 10, wherein the one or more data transmissions received by the GCS over the surveillance network comprise COT metadata obtained by the plurality of COT-capable sensors.

12. The system of claim 11, wherein the instructions further cause the processor to transmit instructions causing the system to associate the COT metadata obtained by the plurality of COT-capable sensors with one or more identified targets.

13. The system of claim 11, wherein at least a first portion of the plurality of COT-capable sensors are provided on one or more of a plurality of unmanned aerial vehicles.

14. The system of claim 13, wherein a second portion of the plurality of COT-capable sensors are provided as ground-based sensors, the second portion different than the first portion of the plurality of COT-capable sensors.

15. The system of claim 10, wherein the munitions network and the surveillance network are provided as separate networks.

16. The system of claim 10, where the instructions further cause the processor to transmit instructions causing the system to generate target coordinates for the smart munition by generating a munition control data package including at least the target coordinates, wherein the munition control data package is generated based on at least:

a munition communication protocol determined for the smart munition; and one or more data formats of COT metadata transmissions received from the plurality of COT-capable sensors.

17. A non-transitory computer readable medium storing instructions, which when executed by at least one processor cause the at least one processor to transmit instructions causing the system to:

establish, over a munitions network, a munitions network link between a smart munition and a group communication system (GCS);

generate target coordinates for the smart munition, the target coordinates generated based at least in part on one or more data transmissions received by the GCS over a surveillance network communicatively coupling the GCS to a plurality of Cursor-on-Target (COT)-capable sensors;

transmit the target coordinates to the smart munition via the munitions network link;

program the smart munition with targeting information based at least in part on the target coordinates; and deploy the smart munition based on the programming.

18. The non-transitory computer readable medium of claim 17, wherein:

the one or more data transmissions received by the GCS over the surveillance network comprise COT metadata obtained by the plurality of COT-capable sensors; and the munitions network and the surveillance network are provided as separate networks.

19. The non-transitory computer readable medium of claim 18, wherein:

at least a first portion of the plurality of COT-capable sensors are provided on one or more of a plurality of unmanned aerial vehicles;

a second portion of the plurality of COT-capable sensors are provided as ground-based sensors; and the second portion of the plurality of COT-capable sensors is different from the first portion of the plurality of COT-capable sensors.

20. The non-transitory computer readable medium of claim 17, wherein the instructions further cause the processor to transmit instructions causing the system to generate target coordinates for the smart munition by generating a munition control data, wherein the munition control data package includes at least the target coordinates and is generated based on at least:

a munition communication protocol determined for the smart munition; and one or more data formats of COT metadata transmissions received from the plurality of COT-capable sensors.

* * * * *